US005662319A

United States Patent [19]

Honegger

[11] Patent Number: 5,662,319

[45] Date of Patent: Sep. 2, 1997

[54] APPARATUS FOR PROCESSING PRINTED PRODUCTS

[75] Inventor: Werner Honegger, Bäch, Switzerland

[73] Assignee: Ferag AG, Switzerland

[21] Appl. No.: 672,443

[22] Filed: Jun. 28, 1996

[30] Foreign Application Priority Data

Jun. 30, 1995 [CH] Switzerland ..... 1-918/95

[51] Int. Cl.[6] ..... B65H 39/02

[52] U.S. Cl. ..... 270/58.21; 270/58.2

[58] Field of Search ..... 270/58.21, 58.23, 270/58.18, 58.2; 271/314, 315

[56] References Cited

U.S. PATENT DOCUMENTS

| | | | |
|---|---|---|---|
| 3,951,399 | 4/1976 | Reist . | |
| 4,145,038 | 3/1979 | Mol | 270/58.01 |
| 4,684,116 | 8/1987 | Hänsch . | |
| 4,684,117 | 8/1987 | Honegger et al. . | |
| 4,735,406 | 4/1988 | Weber . | |
| 5,052,666 | 10/1991 | Hänsch . | |
| 5,052,667 | 10/1991 | Hänsch . | |
| 5,094,438 | 3/1992 | Reist et al. . | |
| 5,165,672 | 11/1992 | Backman . | |
| 5,269,504 | 12/1993 | Backman . | |
| 5,292,110 | 3/1994 | Honegger . | |
| 5,324,014 | 6/1994 | Honegger et al. . | |
| 5,562,278 | 10/1996 | Muller et al. | 270/58.21 |

FOREIGN PATENT DOCUMENTS

| | | |
|---|---|---|
| 0354343 | 2/1990 | European Pat. Off. . |
| 0510525 | 10/1992 | European Pat. Off. . |
| 0550828 | 7/1993 | European Pat. Off. . |
| 2247408 | 5/1975 | France . |
| 3620945 | 1/1987 | Germany . |
| 9104934 | 4/1991 | WIPO . |

*Primary Examiner*—Hoang Nguyen
*Attorney, Agent, or Firm*—Brinks Hofer Gilson & Lione

[57] ABSTRACT

A conveying device has pocket-like receiving parts that are moved along a rotary path. The receiving parts are arranged one behind the other and transversely with respect to the rotary path. Printed products are introduced into the receiving parts by a feeder. As a result, these printed products come to rest against a base. During the rotation of the receiving parts, the printed products, bearing on a wall and/or a guide plate, slide into clamps of a transporting device. The transporting device is separate from the conveying device, and its clamps are arranged one behind the other and driven in circulation along a continuous movement path. A section of the movement path runs transversely with respect to the rotary path and the receiving parts. In this section, the printed products retained by the clamps are transported in the receiving parts and in the longitudinal direction thereof.

12 Claims, 9 Drawing Sheets

APPARATUS FOR PROCESSING PRINTED PRODUCTS

BACKGROUND OF THE INVENTION

The present invention relates to an apparatus for processing printed products. In particular, the present invention relates to an apparatus having a conveying device with pocket-like receiving parts for processing printed products.

An apparatus of this type is disclosed in U.S. Pat. No. 5,094,438 and the corresponding EP-A-0453343. This apparatus has a conveying device with a plurality of receiving parts that are arranged in a drum-like manner around a common horizontal rotary axis and have a radially inner base and outer opening. Each receiving part is assigned a carriage that can be moved in the direction of the rotary axis, and is mounted on a wall that bounds the receiving part. The wall runs parallel to the rotary axis and forms the base of the receiving part. Arranged on the carriage at a distance (one behind the other, in the direction of the rotary axis) are clamps which interact with a wall element of the carriage. Those clamps can be changed over together, by a control device, from a closed position, into an open position, and back again. The carriages are also connected to a drive in order to be moved, during a rotation of the receiving parts around the rotary axis, by one working stroke in the longitudinal direction of the receiving parts and by one return stroke in the opposite direction.

This apparatus also has feeders that are arranged one behind the other (in the direction of the rotary axis of the conveying device) and are used to introduce one printed product into each receiving part running past beneath them. The printed products come to rest on the base by way of their leading edge, relative to the introduction direction. The printed products are then retained by the clamps being closed and, during a rotation of the receiving part around the rotary axis, are transported by a working stroke to the next feeder and ultimately to a remover. At each feeder, with the exception of the last feeder (with respect to the transporting direction) a further printed product is added and, in the manner of collation, is arranged congruently with printed products that are already present in the receiving part. The last feeder may be used to position a folded printed product, in a straddling manner, on a wall that bounds the receiving part and over the collated printed product.

In this known apparatus, the design of the receiving parts with the walls and the carriages, guided thereon, and with the clamps, involves a high degree of outlay and takes up a considerable amount of space.

Accordingly, an object of the present invention is to develop an apparatus of the generic type such that the construction of the receiving parts is simplified and the space requirement of the conveying device is thus reduced. Alternatively, in the event that the amount of space is the same, a larger number of receiving parts is permitted by the present invention. For instance, in the apparatus of the present invention, the transporting device is separate from the conveying device and is arranged outside the receiving parts. This arrangement permits a simple and space-saving design of the conveying device and free access to the transporting device.

SUMMARY OF THE INVENTION

The present invention provides an apparatus for processing printed products comprising a conveying device having a plurality of pocket-like receiving parts driven in a rotary path, at least one feeder for introducing printed products into the receiving parts, and a transporting device having a plurality of controlled clamps separate from the conveying device for transporting the printed products in the receiving parts. The receiving parts are arranged one behind the other and transversely with respect to the rotary path. In addition, the receiving parts also have a base and an opening opposite the base.

The clamps are arranged one behind the other and circulated along a continuous movement path, with at least a section of the movement path running transversely with respect to the rotary path. The clamps are further arranged in the section at the openings of the receiving parts. The clamps include a mouth that is directed toward an interior of the receiving part. The mouth is capable of retaining and transporting printed products that are arranged in different receiving parts at a border region of the printed products remote from the base.

DETAILED DESCRIPTION

Figure 1:
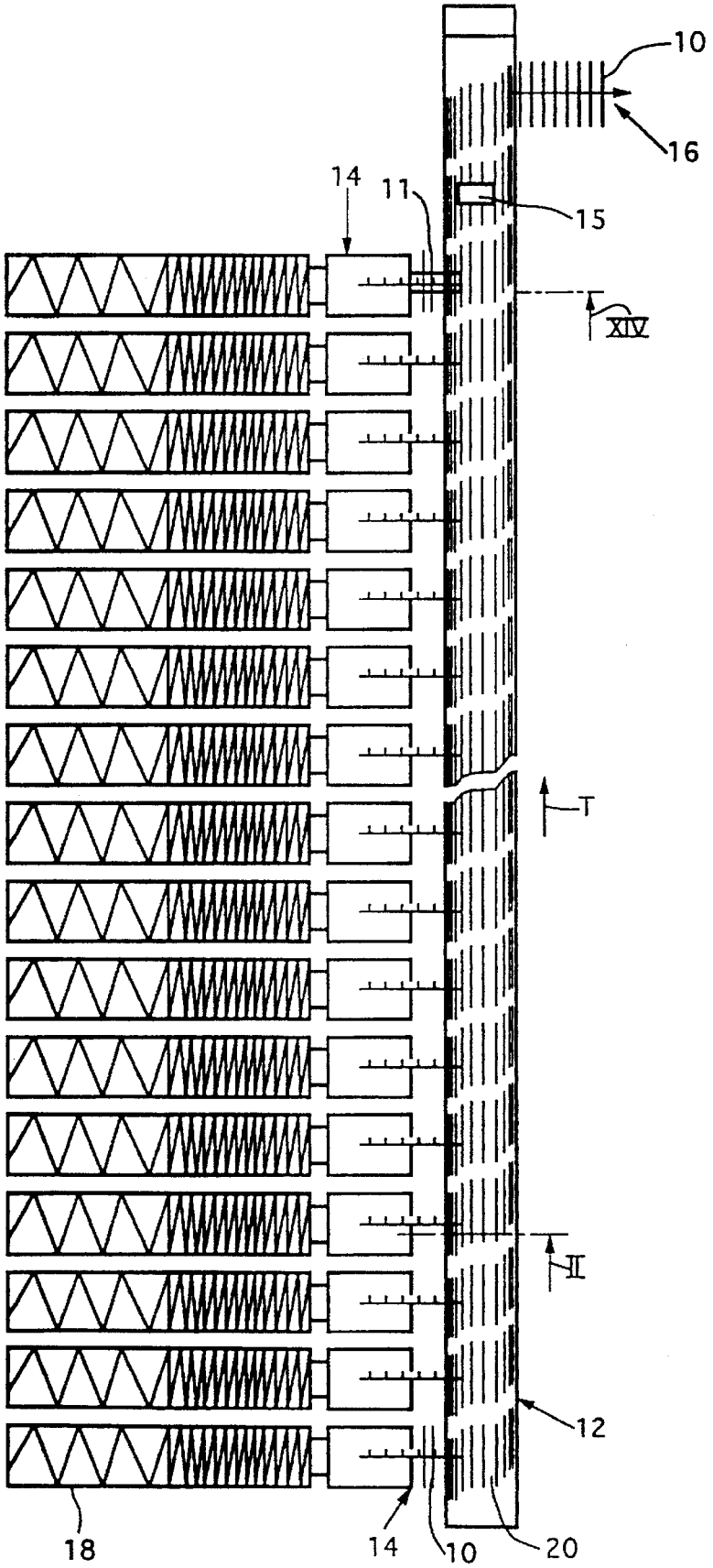
FIG. 1 shows a plan view of an apparatus for processing printed products, the apparatus having a conveying device with receiving parts that are arranged in the manner of a drum around a horizontal rotary axis, and a plurality of feeders for the printed products.

FIG. 1 shows an apparatus for processing printed products 10, a conveying device 12, designed in a drum-like manner, feeders 14, arranged one behind the other along the conveying device, and a remover 16, arranged downstream of the feeder, with respect to a transporting direction T. The feeders 14 are used for feeding to the conveying device 12 printed products 10 which are supplied from a storage unit 18. At the conveying device 12, the printed products are transported in the transporting direction T from one feeder to the next, and ultimately to the remover 16 With the exception of the feeder 14 that is arranged directly upstream of the remover 16, all the feeders are used to introduce printed products 10 into receiving parts 20 of the conveying device 12. At the conveying device 12, the printed products are brought together in the manner of collation. The last feeder 14 may be used to position one folded printed product 11, in a straddling manner, on the collated printed products 10. The folded printed products 11, with the collated printed products 10 arranged therein, form finished products 10'. The finished products 10' are stapled, if necessary, by a stapling apparatus 15 and are then transported away from the conveying device 12 by the remover 16.

Figure 2:
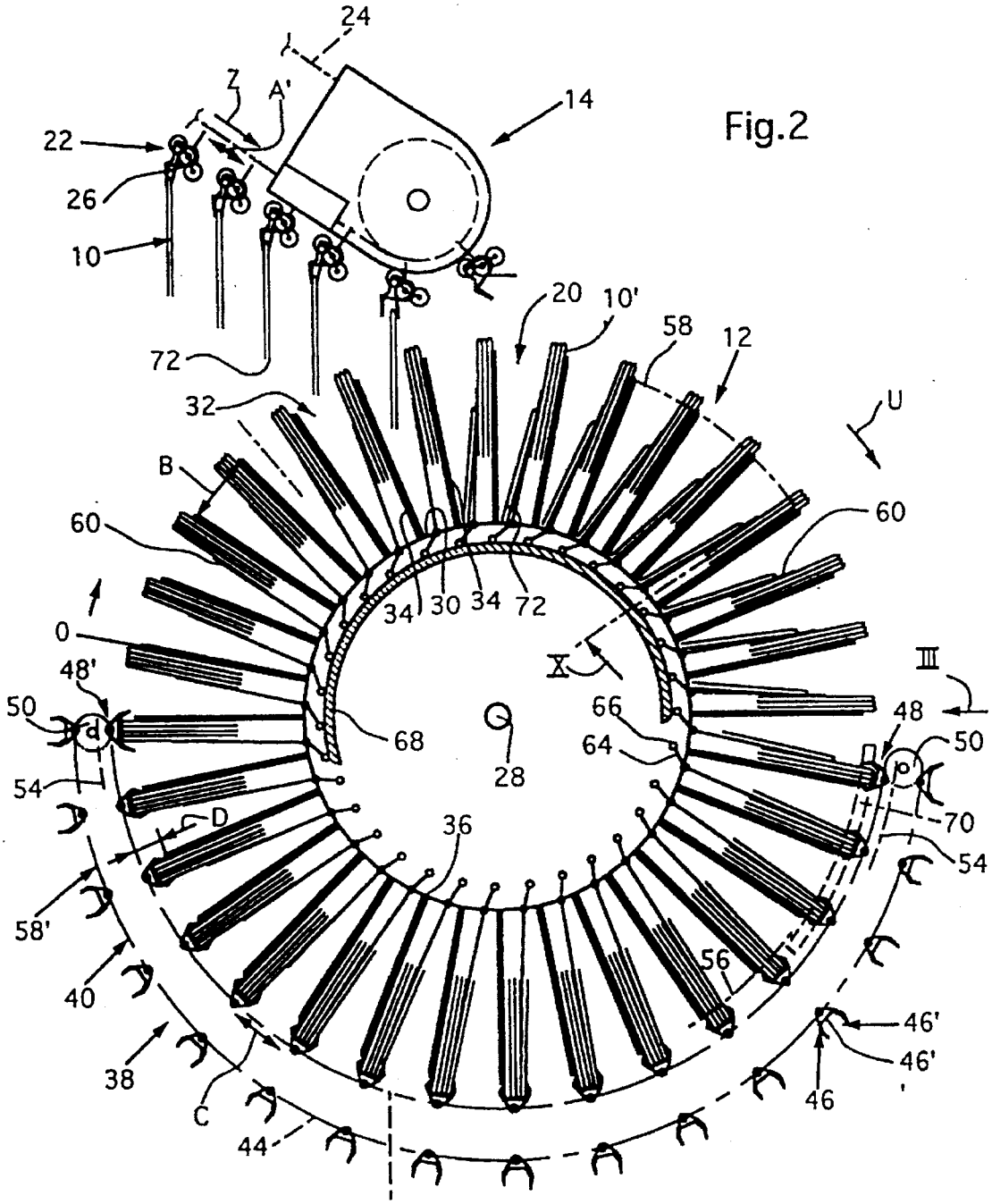
FIG. 2 shows a cross-sectional view of the apparatus for processing printed products of FIG. 1, taken along line II of FIG. 1, the apparatus having a transporting device that is arranged beneath the conveying device and is used to transport the printed products.

As shown in FIG. 2, each feeder 14 has a clamp-type conveyor 22 with individually controllable conveying clamps 26. The clamps 26 are arranged at a distance A, one behind the other, on an endless drawing element 24, for example a chain, that is driven in circulation in the feed direction Z. The conveying clamps are used to feed printed products 10 individually, in a hanging position, to the conveying device 12, and for discharging them to the conveying device by the conveying clamps 26 being opened.

The plurality of receiving parts 20 are arranged, with a radially inner base 30 and an outer opening 32, in the manner of a drum around a common horizontal rotary axis 28. As seen in the circumferential direction of the drum-like conveying device 12, the receiving parts 20 are separated from one another by planar walls 34 that run parallel to the rotary axis 28 and at least approximately in the radial direction with respect to the same. The walls 34 are fastened radially onto the outside of a hollow shaft 36 that is coaxial with the rotary axis 28 and is driven in rotation in a rotational direction U. The hollow shaft 36 also forms the base 30 of the receiving parts 20. The distance B between successive walls 34, as measured in the circumferential direction and at their radially outer end, is matched to the distance A between the conveying clamps 26. Accordingly, on rotation of the conveying device 12, the clamp-type conveyor 22 feeds a printed product 10 to each receiving part 20 one after the other.

Arranged beneath the drum-like conveying device 12 is a transporting device 38 that surrounds the conveying device 12 from beneath. The transporting device 38 has clamp-type transporters 40 that are arranged one behind the other in the direction of the rotary axis 28. Each clamp-type transporter 40 runs in a helical manner (see, in particular, FIG. 3), from one feed plane 42, which is aligned at right angles with respect to the rotary axis 28 and the drawing element 24 of the feeder 14, to the feed plane 42 that is assigned to the adjacent feeder 14, with respect to the transporting direction T.

The clamp-type transporters 40 have individually controllable clamps 46 that are arranged on an endless drawing member 44, for example, a chain. The distance C between successive clamps 46 and the drive of the drawing member 44 are matched to the conveying device 12. As a result, each clamp 46 coincides with a receiving part 20, and these are moved together in the rotational direction U from the start 48 of the clamp-type transporter 40 to the end 48'. At the start 48 and the end 48' of the clamp-type transporter 40, the drawing member 44 is guided around a deflection wheel 50 and runs between the deflection wheels 50 in, for example, a duct-like guide rail. The deflection wheels 50 are arranged approximately level, in the vertical direction, with the rotary axis 28, and one of the deflection wheels 50 is connected to a drive (not shown) to drive the drawing member 44, with the clamps 46, synchronously with the conveying device 12. The clamps 46 that are located in a region of an active strand 52 of the transporting device 38 are each arranged at the opening 32 of the relevant receiving parts 20. The clamp mouth 46' is directed towards the interior of the receiving parts 20, and the clamps are located at the front wall 34 of the receiving part 20, with respect to the rotational direction U. Furthermore, the drawing member 44 is arranged at a distance D from the walls 34 in the radial direction. As a result, the clamps 46 can be opened and closed at a small distance from the walls 34.

The clamps 46 are prestressed in the closure direction and are temporarily opened in the start region and in the end region of the clamp-type transporters 40. The clamps are opened by a control element 54, for example, a control guide. The section 56, assigned to the active strand 52, of the movement path 56' of the clamps 46, thus runs transversely, with respect to the circular rotary path 58 of the receiving parts 20, around the rotary axis 28. Section 56 also runs transversely, with respect to the receiving parts 20, extending in the direction of the rotary axis 28.

As can be seen from FIG. 2, the clamps 46 grip those printed products 10 that are arranged in the receiving parts 20 at their border region 10" which is remote from the base 30. The border region 10" also projects through the opening 32, in the radial direction, beyond the receiving parts 20. In the base of the clamp mouth 46', the clamps 46 have a stop 46" for the printed products 10.

Figure 9:
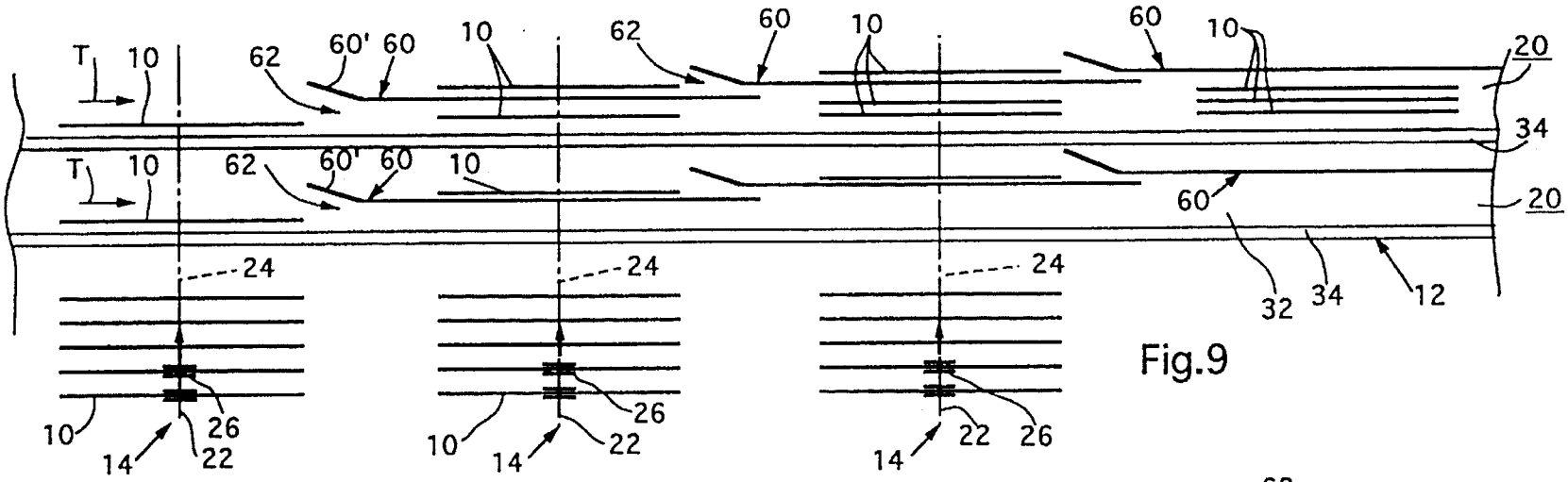
FIG. 9 shows two receiving parts of the apparatus shown in FIGS. 1–8, the receiving parts having guide elements and printed products arranged therein.
Figure 10:
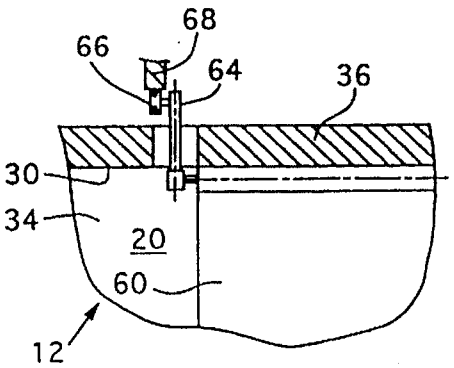
FIG. 10 shows a cross-sectional view of the apparatus for processing printed products of FIGS. 1 and 2, taken along line X of FIG. 2.
Figure 11:
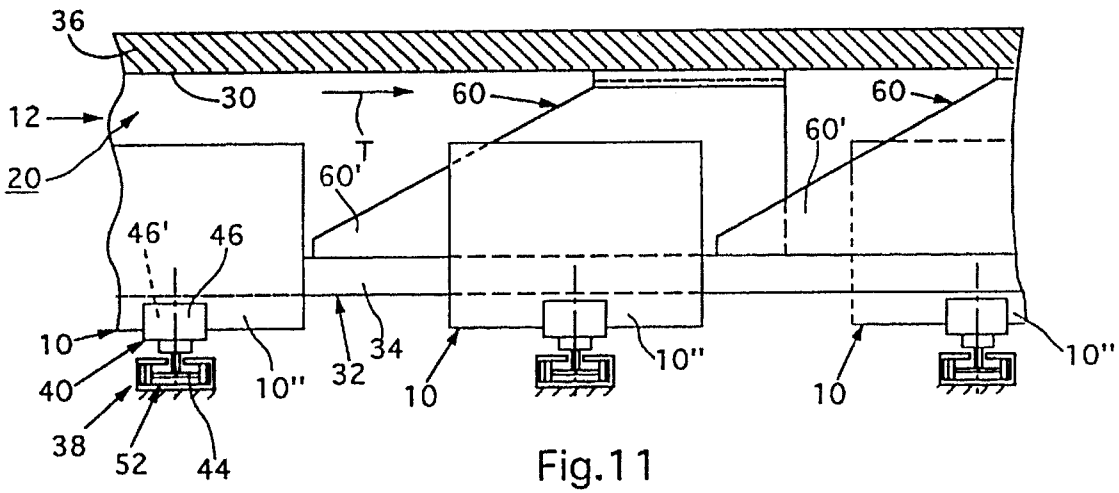
FIG. 11 shows a cross-sectional view of the apparatus for processing printed products of FIGS. 1 and 5, taken along line XI of FIG. 5.

Arranged in each receiving part 20 are guide plates 60, the preferred shape of which can be seen best in FIGS. 9–11. Each receiving part 20 of the drum-like conveying device 12 shown in FIGS. 1 and 2, has such a guide plate 60 at each feed plane 42, apart from the first and last feeders 14, with respect to the transporting direction. However, it is also conceivable that guide plates 60 could be provided there. The trapezoidal guide plates 60 are mounted approximately centrally between the walls 32, on the hollow shaft 36, and around pins running parallel to the rotary axis 28. The plates are prestressed in the direction of the front wall 34 of the receiving part 20, and their end region 60' tapers counter to the transporting direction T. The end region 60' is bent away from the wall 34 in order, together with the wall, to form an inlet 62 for the printed products 10 that tapers in the transporting direction T (see, in particular, FIG. 9).

The guide plates 60 are each connected to a lever 64 that passes freely through the hollow shaft 36 and at whose free end a roller 66 is mounted (see FIG. 10). A pressure-exerting guide 68 is assigned to the upper region of the rotary path 58 of the receiving parts 20 and interacts with the roller. The guide 68 is used to increase the force with which the guide plates 60 are forced in the direction of the front wall 34 of the receiving parts 20 (see FIG. 2).

For the sake of completeness, it should be mentioned that each guide rail 70 is arranged in a stationary manner in the start region of the clamp-type transporters 40, and the rail is used to act on the printed products 10 on their trailing side edge in the border region 10", with respect to the transporting direction T. Accordingly, in order, with the clamp mouth 46' open, the rail pushes the printed products 10 with the clamps 46 in the transporting direction T in the receiving part 20 until the clamp jaw 46' is closed. The printed products 10 are thereby retained by the closed clamp jaw 46' at the border region 10" (see FIGS. 2 and 4).

The apparatus shown in FIGS. 1–4 and 9–11 functions as follows. The first feeder 14, with respect to the transporting direction T, feeds a printed product 10 to each receiving part 20 through the opening 32 of the receiving part. The first feeder allows the printed product to drop into the receiving part 20 by the conveying clamp 26 being opened. As a result, the lower edge of the printed product 10 comes to rest, on the base 30 of the receiving part 20. As the conveying device 12 continues to rotate, the printed product 10 comes to rest flatly on the front wall 34 of the receiving part 20. In the start region of the clamp-type transporter 40, the printed product 10 slides outward away from the base 30 in the radial direction, and its border region 10" slides into the open mouth 46' of a clamp 46. In this arrangement, the printed product 10 is pushed in the transporting direction T by the guide rail 70, parallel to the movement path 56 of the clamps 46, until the relevant clamp 46 is closed by running off the control element 54 (see FIG. 4 at the feeder 14 on the bottom, and FIGS. 9 and 11 at the feeder 14 on the far left-hand side). As the conveying device 12 continues to rotate, the printed product 10, retained by the clamp 46, is then transported in the receiving part 20 and in the transporting direction T, to the end 48' of the clamp-type transporter 40. The printed product 10 is then transported to the next feed plane 42, where it is released by the clamp jaw 46' being opened. During this transportation, the printed product 10 has been pushed, with its leading side edge in front, with respect to the transporting direction T, through the inlet 62 between a guide plate 60 and the front wall 34 of the receiving part 20. Approximately at the same time as the clamp 46 is opened at the end 48', the roller 66 assigned to the relevant guide 60 runs onto the pressure-exerting guide 68. As a result, the printed product 10 is held clamped between the front wall 34 and the guide plate 60.

In the same manner, a printed product 10 is fed to the receiving part 20 by each feeder, with the exception of the last. Each of these printed products 10 are introduced between the guide plate 60 and the rear wall of the receiving part 20, with respect to the rotational direction U. As shown in FIG. 2, the printed products 10 then come to rest flatly on the guide plate 60 and slide thereon outward away from the base 30 in the radial direction and into the associated open clamps 46. These printed products 10 are then gripped and retained by the clamp 46, together with the printed products 10 arranged between the front wall 34 and the guide plate 60, for the purpose of transportation in the arrow direction T. It should be mentioned that the pressure-exerting guide 68 terminates approximately at the start 48 of the clamp-type transporter 40. As a result, in the region of the section of the movement path 56, the guide plates 60 rest on the printed products 10 with only a very small amount of force. During a transporting step in the arrow direction T, each of the printed products 10 that have been collated in this manner are pushed between the next guide plate 60 and the front wall 34 (see, in particular, FIGS. 9 and 11).

Figure 3:
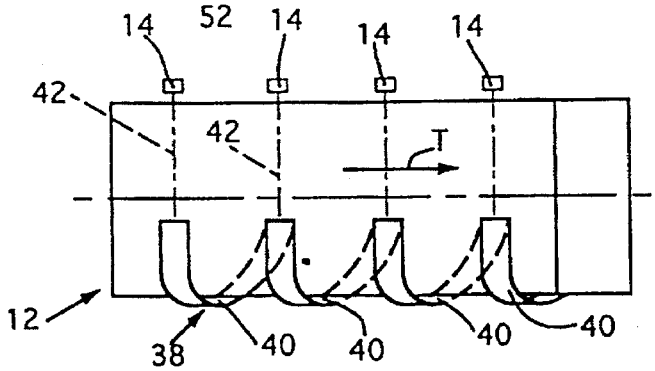
FIG. 3 shows an elevation view, in the direction of arrow III of FIG. 2, of the shortened apparatus shown in FIGS. 1 and 2.
Figure 4:
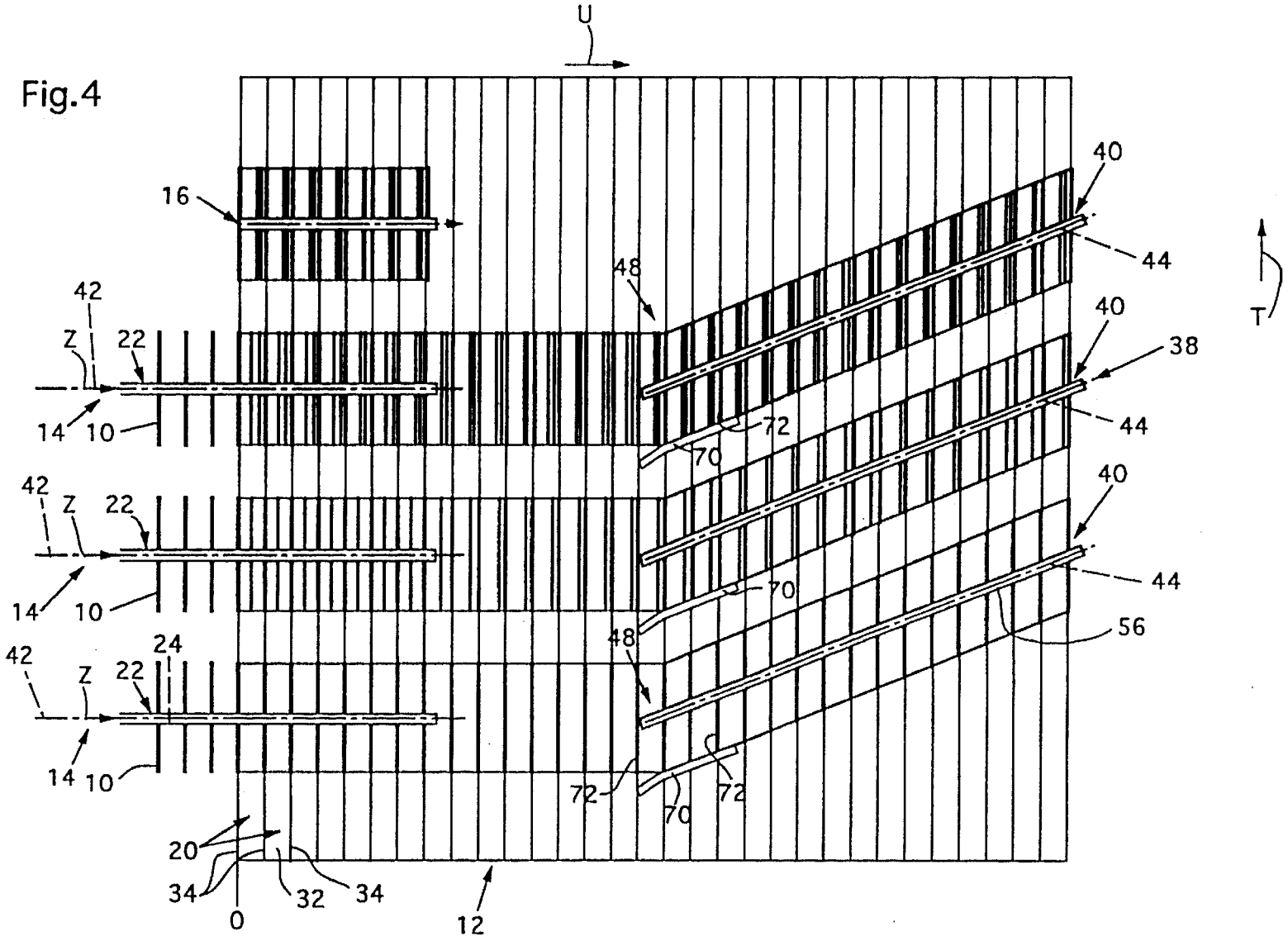
FIG. 4 shows a projected development of the apparatus shown in FIGS. 2 and 3.
Figure 5:
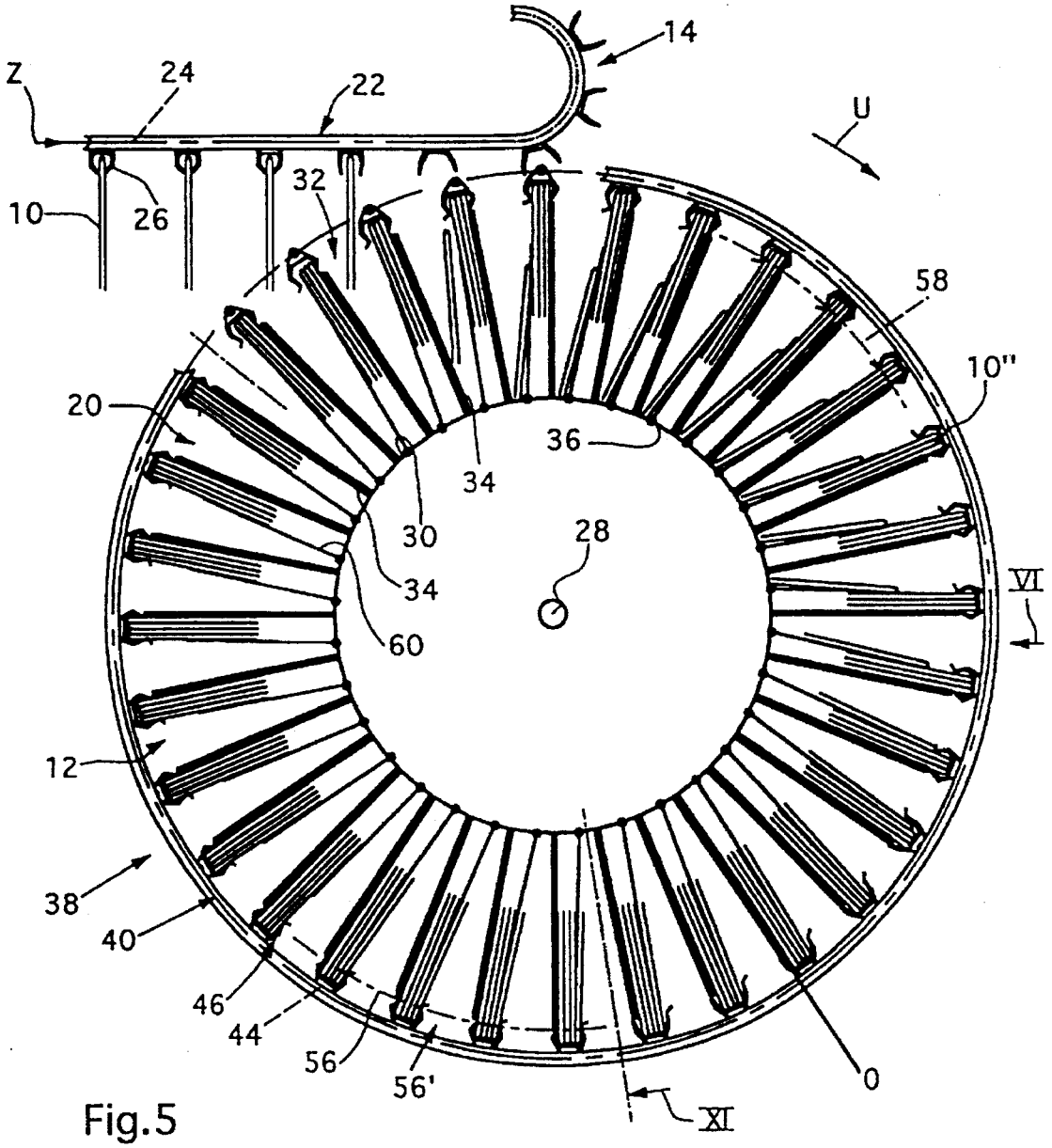
FIG. 5 shows a cross-sectional view of the apparatus for processing printed products of FIG. 1, taken along line II of FIG. 1, through the conveying device and a transporting device, which runs around the conveying device and is used to transport the printed products.
Figure 8:
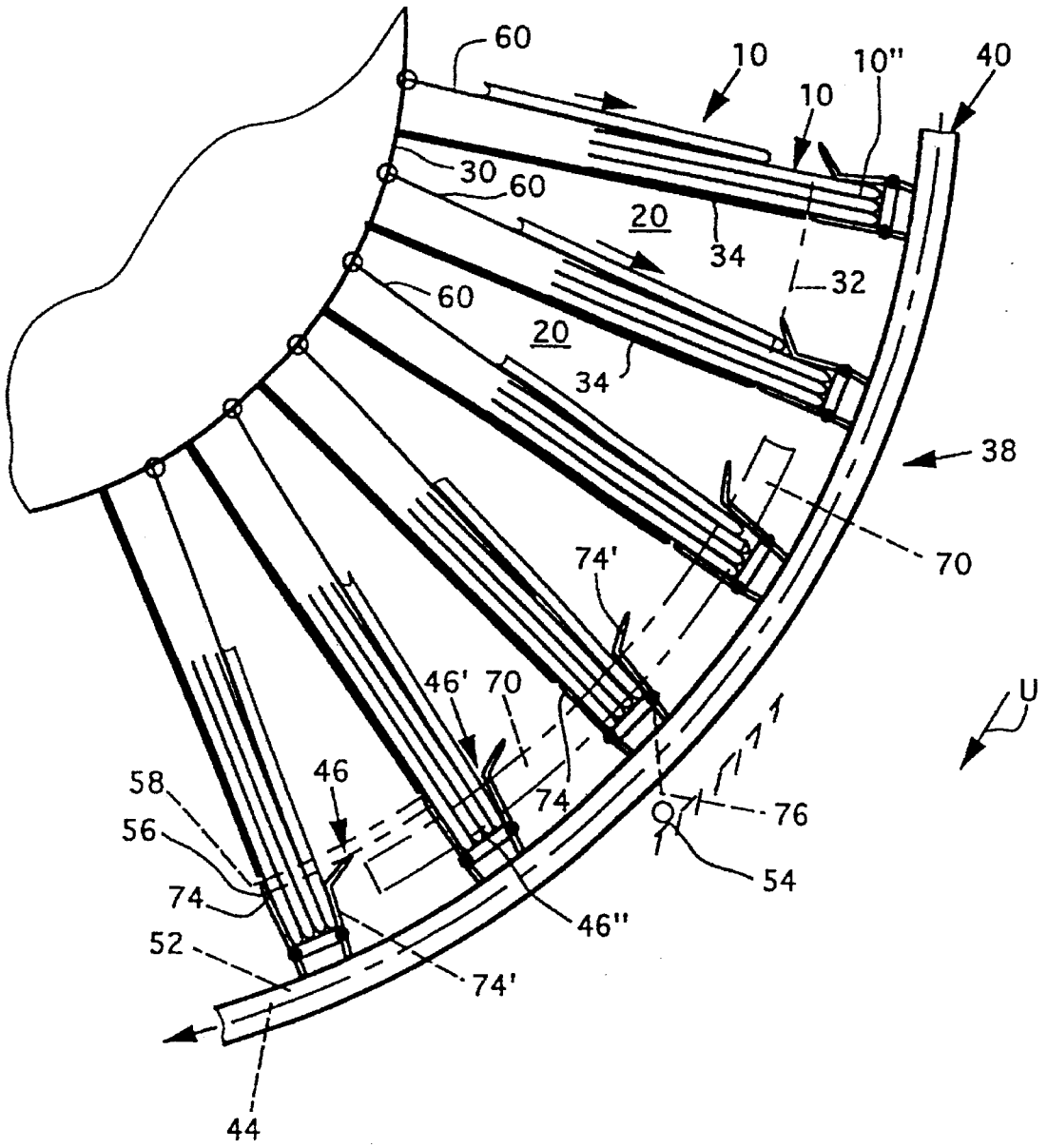
FIG. 8 shows, on an enlarged scale with respect to FIG. 5, a detail of the conveying and transporting devices shown in FIG. 5.

In the embodiment of the apparatus shown in FIGS. 5–8, the drum-like conveying device 12 is of a similar design as in the embodiment shown in FIGS. 2–4 and described above. In the conveying device 12 shown in FIGS. 5–8, however, the guide plates 60 are no longer connected to a lever 64 for increasing the force by which they are moved in the direction of the respective front wall 34 of the receiving parts 20. As shown in FIGS. 5 and 8, the guide plates 60 here too are fastened on the base 30 between the walls 34. They are prestressed with a small amount of force in the direction of the front wall of the receiving parts 20, with respect to the rotational direction U. Otherwise, the form of the guide plates 60 corresponds to the form shown in. FIGS. 9 and 11. As far as the construction of the conveying device 12 is concerned, one is referred to the description above. The reference symbols used here correspond to those used above.

A fundamental difference from the embodiment shown in FIGS. 2–4 consists in the configuration of the transporting device 38. Here, a single clamp-type transporter 40 is provided with clamps 46 that circulate along a continuous movement path. The active section 56 of the movement path 56' runs in a helical manner with a plurality of turns, at a constant pitch, around the drum-like conveying device 12. The section 56 of the movement path 56' is thus arranged transversely with respect to the receiving parts 20, running in the direction of the rotary axis 28, and transversely with respect to the circular rotary path 58, running around the rotary axis 28 of the receiving parts 20.

The clamp-type transporter 40 again has individually controllable clamps 46 that are arranged at the distance C, one behind the other, on an endless drawing member 44. Successive clamps 46 are arranged at the opening 32 of successive receiving parts 20 with their clamp mouths 46' directed toward the interior of the relevant receiving part. As shown in FIG. 8, the leading clamp jaw, with respect to the rotational direction U, is aligned with the front wall 34 of the relevant receiving part 20, also with respect to the rotational direction U, and is slightly spaced apart from the wall in the radial direction. As a result, the clamp 46 can be moved along the wall 34 in the axial direction. The clamp jaw 74' that follows the clamp jaw 74, with respect to the rotational direction U, is arranged in a pivotable manner and prestressed in the direction of the clamp jaw 74. The clamp jaw 74' is also connected to a control lever 76 that can be pivoted into the open position by a guide-like control element 54 to open the clamp mouth 46' formed by the clamp jaws 74, 74'.

Figure 6:
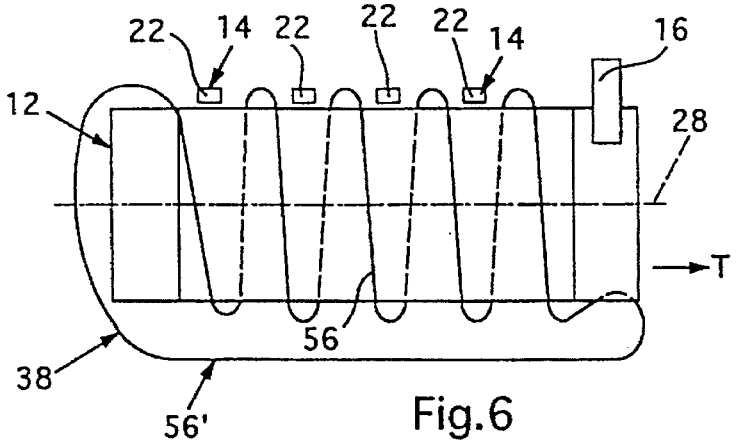
FIG. 6 shows an elevation view, in the direction of arrow VI of FIG. 5, of the shortened apparatus shown in FIGS. 1 and 5.
Figure 7:
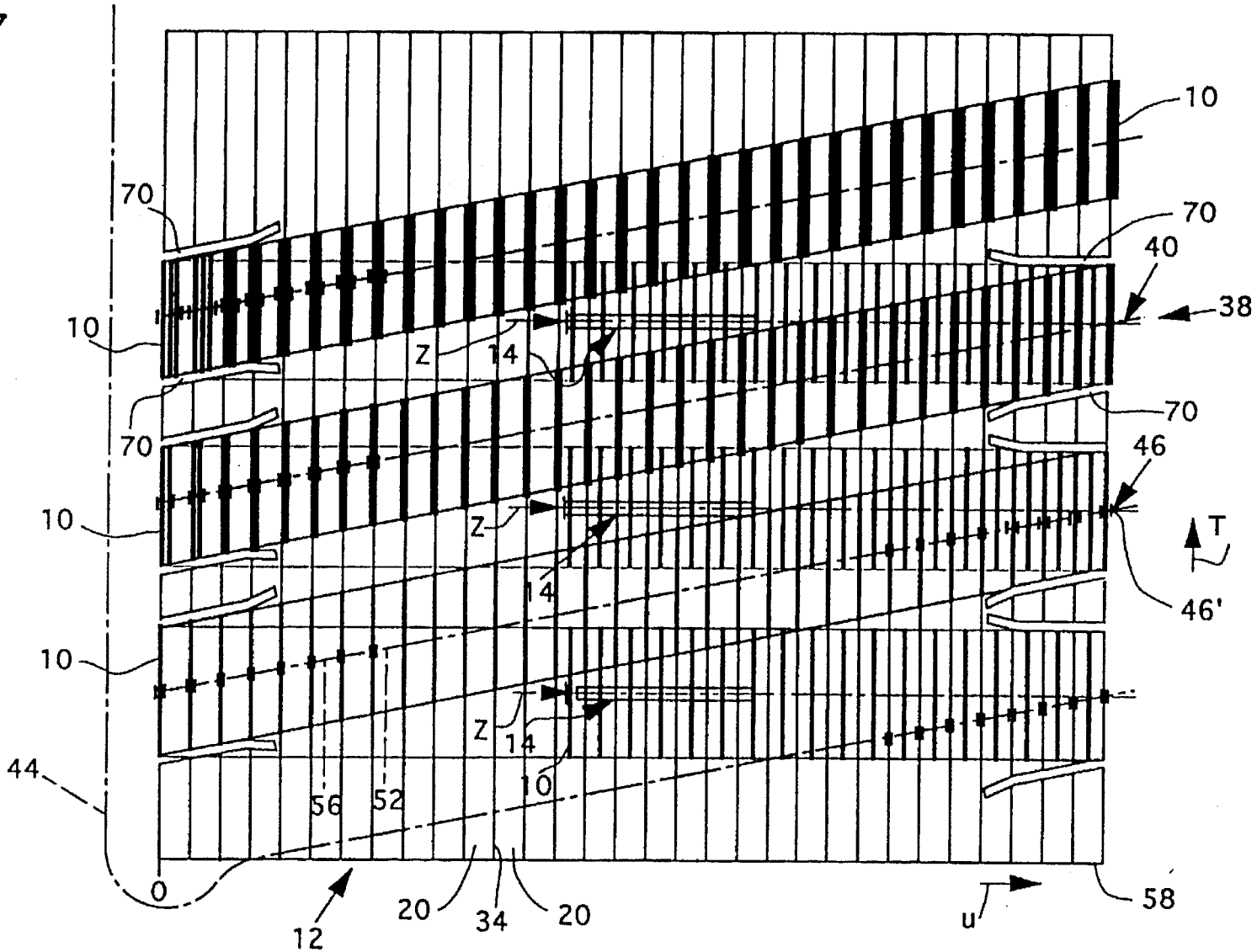
FIG. 7 shows a projected development of the apparatus shown in FIGS. 5 and 6.

In the embodiment shown in FIG. 5, the feeders 14 are designed as clamp-type conveyors 22. The clamp-type conveyors 22 are used to feed printed products 10, in a hanging position, to the receiving parts 20 and allow them to drop by opening the conveying clamps 26. As a result, the lower edges of the printed products 10 come to rest on the base 30 of the receiving parts 20. FIG. 6 shows the arrangement of the clamp-type conveyors 22 with respect to the active section 56 of the movement path of the clamps 46. The clamp-type conveyors 22 are precisely arranged between the turns of the helical movement path 56, with respect to the direction of the rotary axis 28, so that the printed products 10 that are introduced into the receiving parts 20 assume the correct position with respect to the transporting device 38. On rotation of the conveying device 12, the printed products 10 slide, on the wall 34 and/or the guide plate 60, outward away from the base 30 in the radial direction, and into the region of the guide rails 70 and the clamps 46 (see, in particular, FIG. 7).

The lower edges of the printed products 10 that are introduced into the receiving parts 20 by the first feeder 14, with respect to the transporting direction T in FIG. 6, come to rest on the base 30 and, during rotation of the conveying device 12, flatly on the front wall 34. After passing beneath a horizontal plane through the rotary axis 28, the printed product 10 slides outward away from the base 30 in the radial direction. The border region 10" of the printed product 10, which now projects beyond the opening 20, proceeds to slide between the guide rails 70 and into the open clamp mouth 46' of the relevant clamp 46. The printed product 10 is aligned by guide rails 70 in the direction of the rotary axis 28, and is conveyed parallel to the movement path 56 until the clamp 46, is closed. The printed product 10 is secured by closing clamp mouth 46, and is transported continuously in the transporting direction T during rotation around the rotary axis 28. The printed product is then introduced, through the inlet 62, between the guide plate 60 and the front wall 34 of the receiving part 20. The feeder 14 that follows the first feeder 14, with respect to the transporting direction T, introduce the printed products 10 between the guide plate 60 and the rear wall 34 of the receiving parts 20, with respect to the rotational direction U. Consequently, the printed products 10 that are retained by the clamps 46 and have already been introduced earlier into the receiving parts 20, can be transported further in the axial direction without those printed products 10 that have newly been introduced into the receiving parts 20 being carried along. As a result of the rotation of the conveying device 12, the printed products 10 come to rest flatly on the relevant guide plate 60. After passing beneath a horizontal plane through the rotary axis 28, the printed products 10 slide on the guide plate 60 radially outward away from the base 30, once again between guide rails 70, and into a clamp 46 that is now open. The guide rails 70 then transport, in the transporting direction T and until the clamp 46 is closed, the printed products 10 that have been retained by the clamp up until then and the newly added printed product 10. The printed products 10 that have been collated in this manner are then transported again, in the arrow direction T, by the closed clamp 46 in the amount of one turn of the movement path 56.

Figure 12:
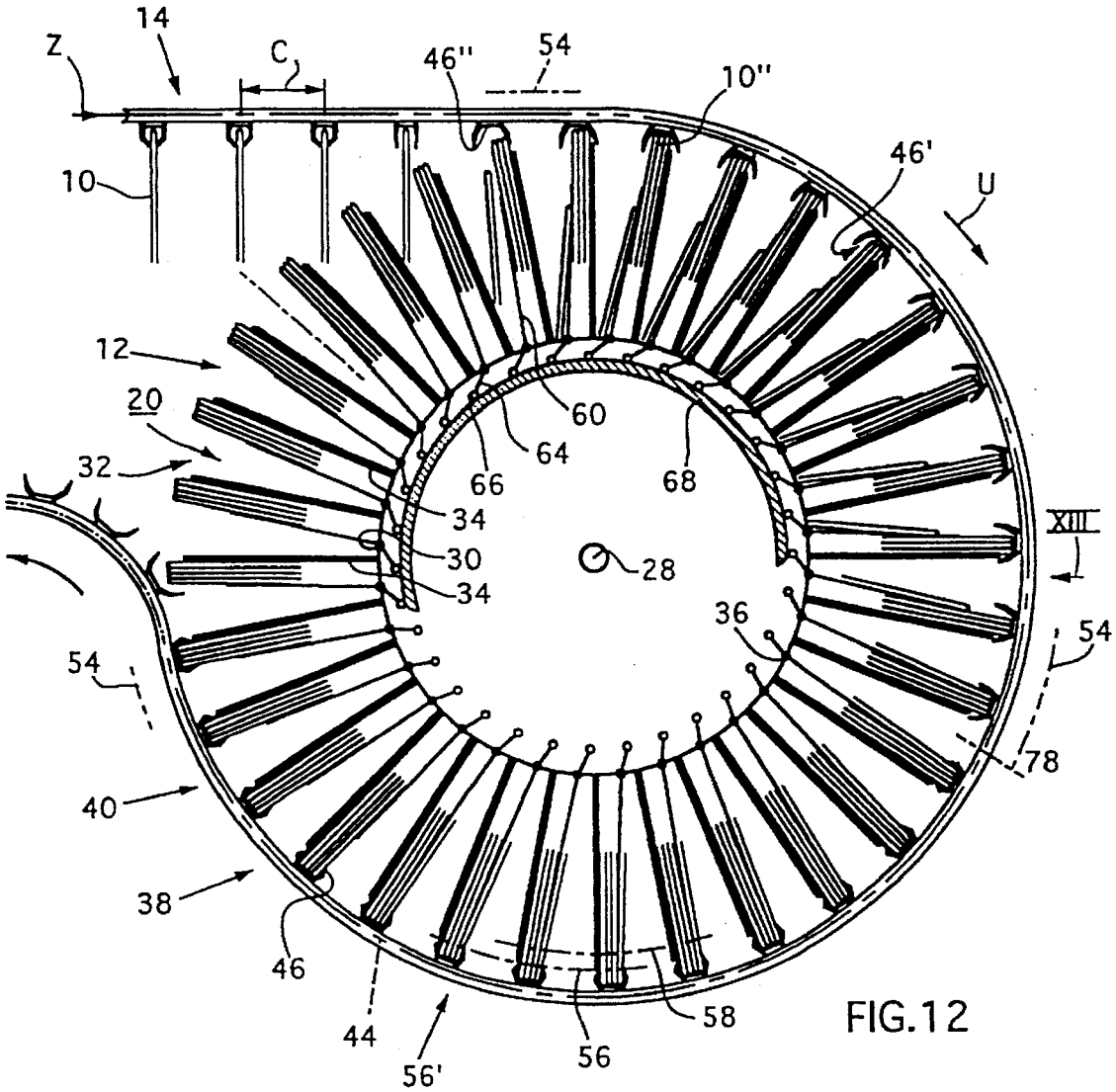
FIG. 12 shows, in the same representation as FIGS. 2 and 5, a further embodiment of an apparatus according to the present invention, wherein the feeders, designed as clamp-type conveyors, are guided around the conveying device and act as a transporting device.
Figure 13:
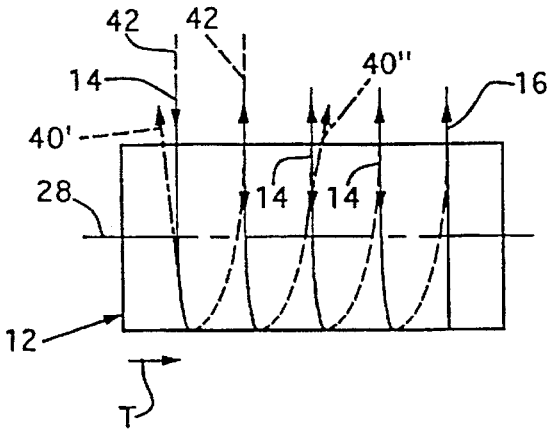
FIG. 13 shows an elevation view, in the direction of arrow XIII of FIG. 12, of the shortened apparatus shown in FIGS. 1 and 12.

In the embodiment of the apparatus shown in FIGS. 12 and 13, the drum-like conveying device 12 is of the same design as in the embodiment shown in FIGS. 2–4. The reference symbols used for FIGS. 2–4 also apply to FIGS. 12 and 13, and one is referred to the corresponding parts of the description. The transporting device 38 is formed by clamp-type transporters 40 which, at the same time, are also clamp-type conveyors 22 of the feeder 14. The movement path of the clamps 46, which are driven in both the feed direction Z and the rotational direction U, runs in a horizontal direction, approximately tangential to the conveying device 12, above the conveying device, through approximately 270° around the conveying device, and from there back to a storage unit 18 (see FIG. 1). The active section, running along the conveying device 12, of the movement path 56, runs in the radial direction, with respect to the rotary axis 28, at a small distance from the walls 34 of the receiving parts 20. As a result, the clamps 46 can be opened and closed without coming into contact with the conveying device 12, and can be moved with one component in the direction of the rotary axis 28.

In the embodiment shown, the movement path 56, starting from the storage unit 18, runs in a feed plane 42, arranged at right angles with respect to the rotary axis 28, approximately as far as the location designated by 78 in FIG. 12. At location 78, the movement path takes on a helical shape that terminates when it moves away again from the conveying device 12. In this arrangement, the section of the movement path that leads away from the conveying device 12 is located in the feed plane 42 of the next feeder 14, with respect to the transporting direction T. If necessary, the clamp-type transporter 40 may be designed, as disclosed in EP-A-0633212, to permit changes in the distance C between successive clamps 46. A control element 54 for opening the clamps 46 extends from above the conveying device 12, where the movement path approaches the conveying device 12, as far as the location 78, which is arranged beneath a horizontal plane through the rotary axis 28. Location 78 is where the printed products 10 that have been introduced into the receiving parts 20, slide away from the base 30 and into the open clamp 46 because of the slope of the relevant wall 34 and/or of the relevant guide plate 60. All except the first of the clamp-type transporters 40, with respect to the transporting direction T, have such a control element 54. A further control element 54 is assigned to each of the clamp-type transporters 40 and is arranged in the end region of the transporting movement-path section 56.

The manner in which this embodiment functions is illustrated by FIGS. 12 and 13. The printed product 10 that is fed to a receiving part 20 by the first clamp-type transporter 40, with respect to the transporting direction T, is retained by the relevant clamp 46. The printed product 10 is then displaced in the transporting direction T in the receiving part 20 and is pushed in between a guide plate 60 and the front wall 34, as described above. Approximately level with the rotary axis 28, the relevant clamp 46 is opened and the then released printed product 10 is held clamped between the wall 34 and the guide plate 60. The pressure-exerting force of the guide plate 60 is increased by the roller 66 running onto the pressure-exerting guide 68. As seen in the axial direction, the printed product 10 then remains at a standstill until it reaches the location 78 again. The printed product 10 that is fed to the receiving part 20 by the next clamp-type transporter 40, with respect to the transporting direction T, is released by the relevant clamp 46 being opened. As a result, the lower edge of the printed product comes to rest on the base 30. As the conveying device 12 continues to rotate, the printed product comes to rest flatly on the guide plate 60 and then slides on the guide plate away from the base 30 and into the open clamp 46. The clamp 46 then secures the two printed products 10, which are located congruently one on top of the other in a collated manner, for the purpose of transportation in the arrow direction T. The further printed products that are fed to the receiving part 20 are collated in the same manner.

It would, of course, also be conceivable (as indicated by chain-dotted lines in FIG. 13), to arrange the sections 40' of the clamp-type transporters 40 that lead toward the conveying device 12, as well as the sections 40" that lead away from the conveying device 12, in a coil with respect to the rotary axis. The coil then corresponds to the pitch of the movement path of the clamps 46 in the entire section 56 where the movement path 56' runs along the rotary path 58 of the receiving parts 20. In this example, the clamps 46 may be arranged at a fixed distance, one behind the other, on the drawing member 44.

Figure 14:
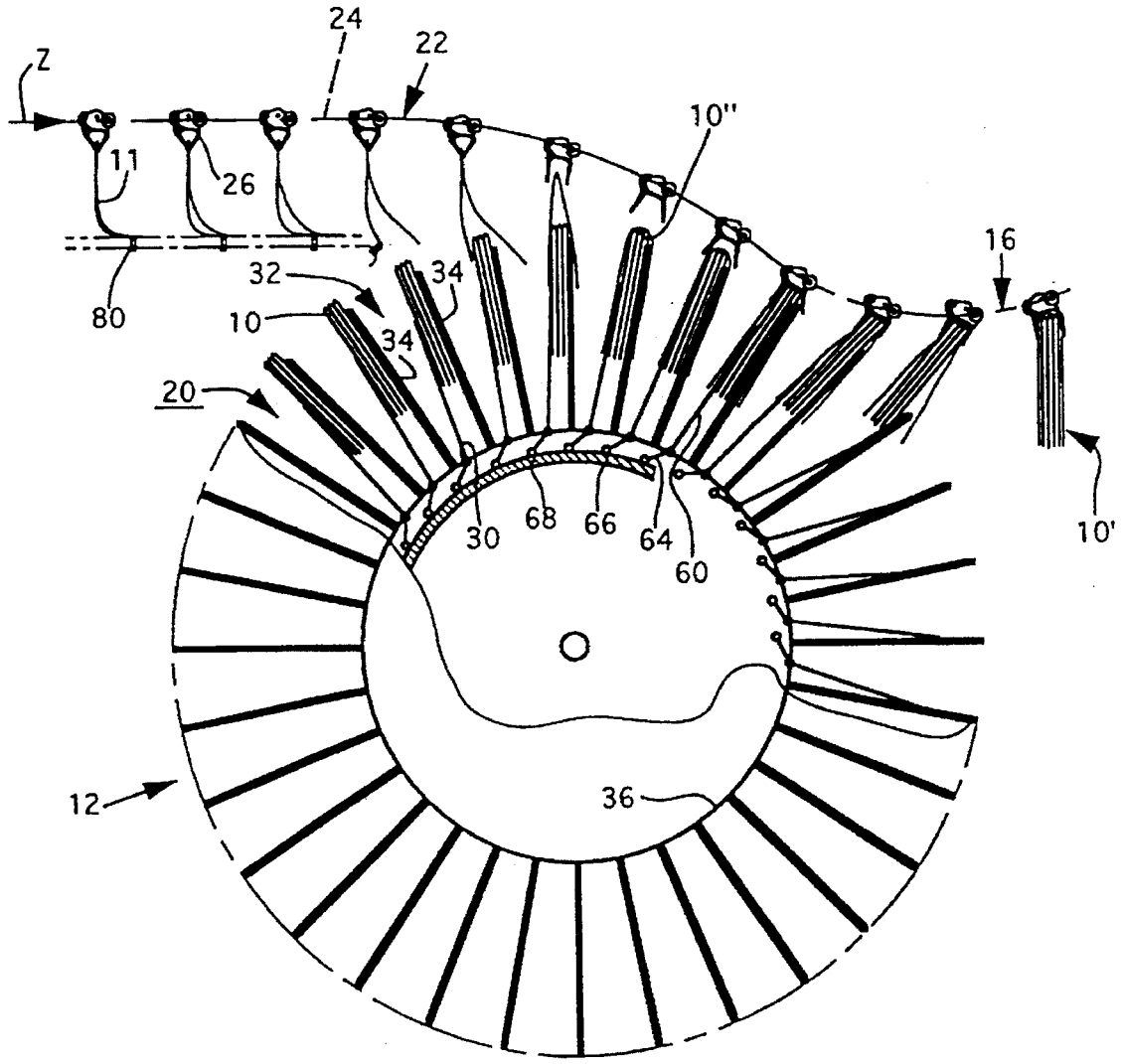
FIG. 14 shows part of the apparatus for processing printed products shown in FIG. 1, in a cross-sectional view taken along line XIV of FIG. 1.

FIG. 14 shows a possible embodiment of the remover 16. This embodiment of the remover 16 serves, at the same time, as a feeder for a folded printed product 11 that is opened and positioned in a straddling manner on the collated printed products 10. The embodiment of the conveying device 12 and transporting device 13 shown in FIG. 14 corresponds to the embodiments shown in FIGS. 1–4. The remover 16, arranged above the conveying device 12, is likewise designed as a clamp-type conveyor 22 with conveying clamps 26 arranged at a distance, one behind the other, on a drawing element 24. These conveying clamps retain the printed product 11 in a hanging position at its fold. An opening device 80 for opening the printed products 11 at their open border remote from the fold, is located beneath the clamp-type conveyor 22 and is arranged upstream of the conveying device 12, with respect to the feed direction Z. The previously collated printed products 16, retained by the relevant wall 34 and the guide plate 60, are introduced into the open printed product 11 from beneath. The open printed product 11 is then allowed to drop by the relevant conveying clamp 26 being opened, and position itself in a straddling manner on the collated printed products 10. The movement path of the clamp-type conveyor 22 then approaches the rotary path 58 of the receiving parts 20. As a result, the relevant open conveying clamp 26 can grip the straddling printed product 11, and the printed products 10 arranged therein, at the border region 10" projecting through the opening 92 and beyond the receiving parts 20. At the same time the conveying clamp 26 is closed for transporting away the finished product 10', the retaining force of the guide plate 60 is also reduced by the pressure-exerting guide 68 releasing the roller 66.

In addition to their function as guides and retainers for the printed products 10 transported in the transporting direction T, the guide plates 60 create, for the printed products 10 introduced into the receiving parts 20, identical conditions for sliding in the radial direction. In addition, the guide plates 60 prevent the undesired carrying-along of the printed products 10 by the printed products that are moved in the transporting direction T.

In the embodiments shown in FIGS. 1–14, the receiving parts 20 run in a circular rotary path 58 around the rotary axis 28. It is, however, also conceivable, for example, to arrange the receiving parts 20 one behind the other on conveying chains, and to guide the conveying chains around deflection axis that are spaced apart from one another in the horizontal direction.

It is also conceivable for the printed products 10 that are allowed to drop into the receiving parts 20 to be raised up from the base 30, for example, by stationary guides, and introduced into the clamps 26. In this arrangement, it is not absolutely necessary for the rotary path 58 of the receiving parts to run so that the printed products 10 slide into the clamp 46 because of the slope 0f the wall 34 and/or of the guide plate 60.

The present invention has been illustrated and described with respect to the preferred embodiments of the invention. It is understood that the invention is not limited thereto, but may be otherwise variously embodied and practiced within the scope of the following claims including all equivalents.

I claim:

1. An apparatus for processing printed products comprising:

a conveying device having a plurality of pocket-like receiving parts driven in a rotary path, the receiving parts being arranged one behind the other and transversely with respect to the rotary path, the receiving parts having a base and an opening opposite the base;

at least one feeder for introducing printed products into the receiving parts; and a transporting device having a plurality of individually controlled clamps, separate from the conveying device, for transporting the printed products within the receiving parts, the clamps being arranged one behind the other and circulated along a continuous movement path, the movement path having a section running transversely with respect to the rotary path and the receiving parts, the clamps further arranged in the section at the openings of the receiving parts, the clamps having a mouth directed toward an interior of the receiving parts, the mouth retaining and transporting the printed products that are arranged in different receiving parts at a border region of the printed products remote from the base.

2. The apparatus of claim 1, wherein the section of the movement path runs at a distance from the openings, and the clamps retain the printed products at a border region of the printed products projecting beyond the openings.

3. The apparatus of claim 1, wherein the section of the movement path of the clamps runs at a constant pitch with respect to the rotary path.

4. The apparatus of claim 3, wherein the clamps are arranged on an endless drawing member.

5. The apparatus of claim 1, wherein the rotary path runs around a horizontal axis, and the section of the movement path runs beneath the rotary path.

6. The apparatus of claim 1, wherein the rotary path runs around a horizontal axis, and the section of the movement path runs around the rotary path.

7. The apparatus of claim 1, wherein the feeder includes a clamp-type conveyor defining the transporting device, the clamp-type conveyor having clamps for feeding the printed products to the receiving parts, the clamps being arranged one behind the other and driven in circulation, the clamps retaining a border region of the printed products.

8. The apparatus of claim 1, wherein the clamps are opened upon running through a region of the movement path, the receiving parts assigned to the relevant clamps in the region move into a position, and the border region of the printed products introduced into the receiving parts slide from the base, in the direction of the clamps, and into the clamp mouth.

9. The apparatus of claim 1, wherein at least two feeders are provided, each receiving part has opposing walls and a guide element between the opposing walls, a printed product supplied by the first feeder comes to lie, during transportation within the receiving part, on one side of the guide element, and a printed product supplied by the second feeder is introduced into the receiving part on the other side of the guide element.

10. The apparatus of claim 1, wherein the conveying device is assigned at least one remover for transporting away the finished products, the remover comprising a clamp-type conveyor with clamps arranged one behind the other on a drawing element, the clamps being driven in circulation.

11. The apparatus of claim 10, wherein a further feeder is provided downstream of a last feeder, with respect to a transporting direction of the printed products, the further feeder feeding folded printed products and positioning the folded, open printed products in a straddling manner over the printed products that have previously been brought together in the individual receiving parts.

12. The apparatus of claim 11, wherein the further feeder transports away the finished products.

* * * * *